United States Patent [19]

Adler

[11] 4,077,329

[45] Mar. 7, 1978

[54] OPENING AND CLOSING MEANS FOR HINGED TROUGH COVERS ON HOPPER CARS

[75] Inventor: Franklin P. Adler, Michigan City, Ind.

[73] Assignee: Pullman Incorporated, Chicago, Ill.

[21] Appl. No.: 706,976

[22] Filed: Jul. 19, 1976

[51] Int. Cl.[2] ..... B61D 7/24; B61D 39/00

[52] U.S. Cl. ..... 105/377; 105/250; 105/290; 105/293

[58] Field of Search ..... 105/240, 244, 245, 247, 105/248, 250, 251, 252, 253, 255, 286, 287, 288, 289, 290, 293, 294, 299, 304, 307, 377

[56] References Cited

U.S. PATENT DOCUMENTS

| | | | |
|---|---|---|---|
| 775,402 | 11/1904 | Hitchcock | 105/290 |
| 1,269,431 | 6/1918 | Guthrie | 105/377 |
| 1,284,111 | 11/1918 | Kestler | 105/290 |
| 3,176,630 | 4/1965 | Schmeider | 105/377 |
| 3,256,836 | 6/1966 | Floehr | 105/289 |
| 3,581,672 | 6/1971 | Aquino | 105/248 |
| 3,626,865 | 12/1971 | Aquino | 105/240 |
| 3,675,590 | 12/1969 | Schuller | 105/290 |

*Primary Examiner*—Drayton E. Hoffman
*Assistant Examiner*—Carl Rowold
*Attorney, Agent, or Firm*—John A. Doninger

[57] ABSTRACT

An elongated hatch opening in the roof of a hopper car includes a pair of hatch covers hinged on opposite sides of the hatch. A motor and operating mechanism supported at the end of the hatch reciprocates a pair of push-pull bars positioned within the hatch opening which in turn are connected to elevating rods connected to the underneath sides of the covers, the elevating rods extending inwardly and upwardly in the closed position and have a universal joint connection with the covers. Upon movement of the push-pull bars the elevating rods move the hatch covers to an upright open position. The elevating rods and the push-pull bars may be located internally or externally of the hatch covers, i.e., inwardly or outwardly of the hopper car body.

12 Claims, 13 Drawing Figures

OPENING AND CLOSING MEANS FOR HINGED TROUGH COVERS ON HOPPER CARS

BACKGROUND OF THE INVENTION

1. Field of the Invention

The present invention relates to railway hopper cars and more particularly to a trough hatch and cover actuating mechanism for opening and closing the hatch.

2. Description of the Prior Art

The prior art relating to elongated trough hatch cover arrangements generally discloses hatch covers which are hingedly connected to one side of the hatch opening and are moved from a closed position over the hatch opening to one side thereof on the roof of the car. Because of the long length of the hatch opening, two or three sections of the cover are provided which in each instance must be individually opened and closed. Conventional hatch covers lie on the roof walkways or running boards to one side of the opening. This prevents the use of the walkways and a man walking on that side of the car roof is forced to walk on the inside of the hatch cover or on the outer edge of the roof. In many instances the hatch covers thereby are damaged and for safety reasons walking of the outer edge of the roof is discouraged. Also in the prior art the individual sections of hatch covers are generally slammed open and slammed shut and this abuse necessarily shortens their service life. In the present arrangement by virtue of the novel operating mechanism the single double door hatch cover may be open and the entire length of the hatch opening. The hatch doors in the open position are disposed vertically and do not lie on the running boards adjacent the hatch opening as in the prior art. Thus, the present arrangement is superior from the standpoint of safety, long life and expeditious operation in that the entire cover may be easily opened for the length of the hatch opening.

SUMMARY OF THE INVENTION

It is the prime object of the present invention to provide an improved hatch cover arrangement including a pair of hinged doors extending substantially the length of the hatch opening. The hatch doors are hinged on opposite sides of the hatch coaming and a motor and operating mechanism is supported at one end of the hatch opening on top of the roof. The motor mechanism is easily operable by the operator to open the hatch covers for the entire length of the hatch opening. The motor is connected to a pair of push-pull rods or bars which are positioned in the hatch opening beneath the hatch covers. A plurality of elevating rods are pivotally connected to the push-pull bars and these extend inwardly and upwardly in the closed position of the covers and have a universal joint connection with the covers. As the push-pull bars are moved longitudinally the hatch covers are opened upwardly and outwardly to a substantially vertical position thus, facilitating loading of material into the interior of the hopper car. The elevating rods and the push-pull bars may be located internally or externally of the hatch covers, i.e., inwardly or outwardly of the hopper car body.

BRIEF DESCRIPTION OF THE DRAWINGS

FIG. 10 being likened to FIG. 6, FIG. 11 being likened to FIG. 7, FIG. 12 being likened to FIG. 8, and FIG. 13 being likened to FIG. 9 of FIGS. 6—9 of the first mentioned embodiment depicting the elevating rods and push-pull bars as being internally of the hopper body.

DESCRIPTION OF THE PREFERRED EMBODIMENT

Figure 1:
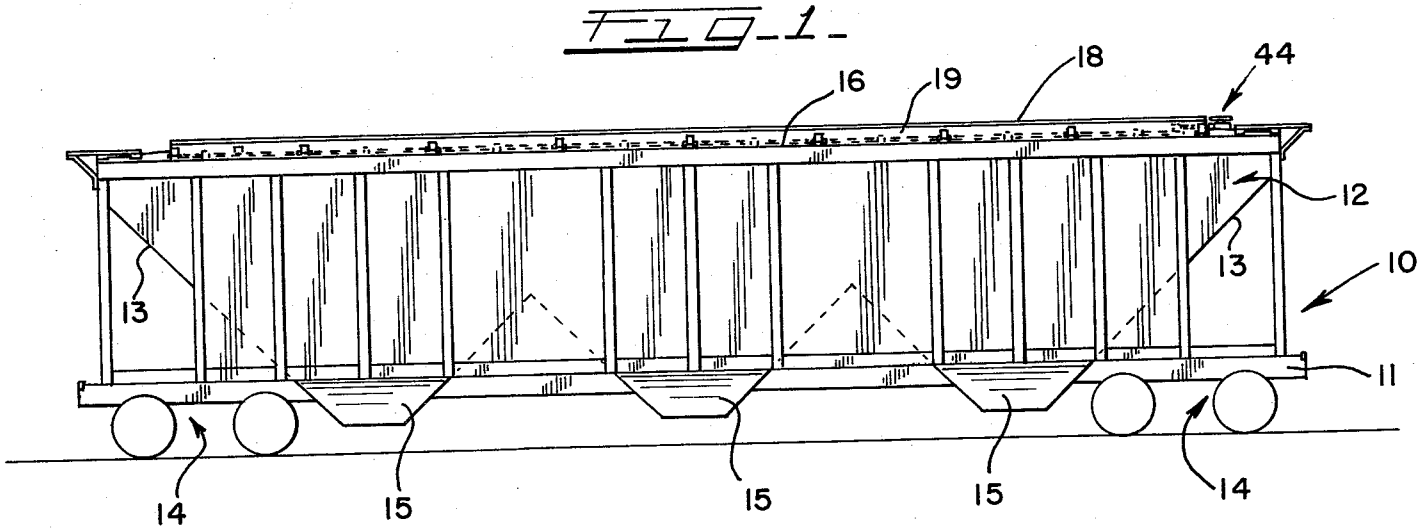
FIG. 1 is a side elevational view of a railway hopper car incorporating the present invention.

Referring particularly to FIG. 1, a railway hopper car 10 includes an underframe and stationary center sill construction 11 supporting a car body 12. The car 10, includes at opposite ends thereof sloping end walls 13 and the car is suitably supported on conventional car trucks 14. The body 12 is provided with a plurality of conventional discharge hoppers 15, which include suitable discharge mechanisms (not shown) for discharging material from within the hoppers downwardly below the car.

Figure 2:
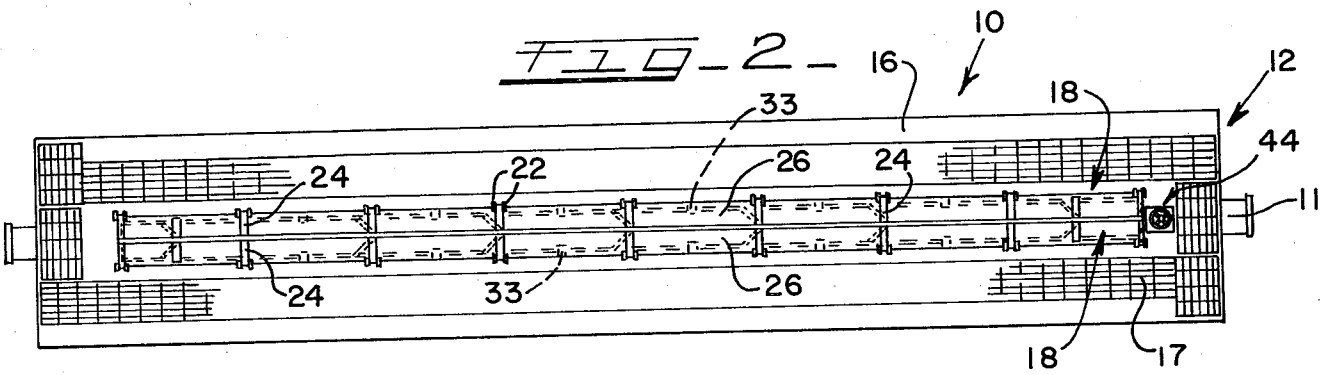
FIG. 2 is a plan view of the railway hopper car disclosed in FIG. 1.
Figure 4:
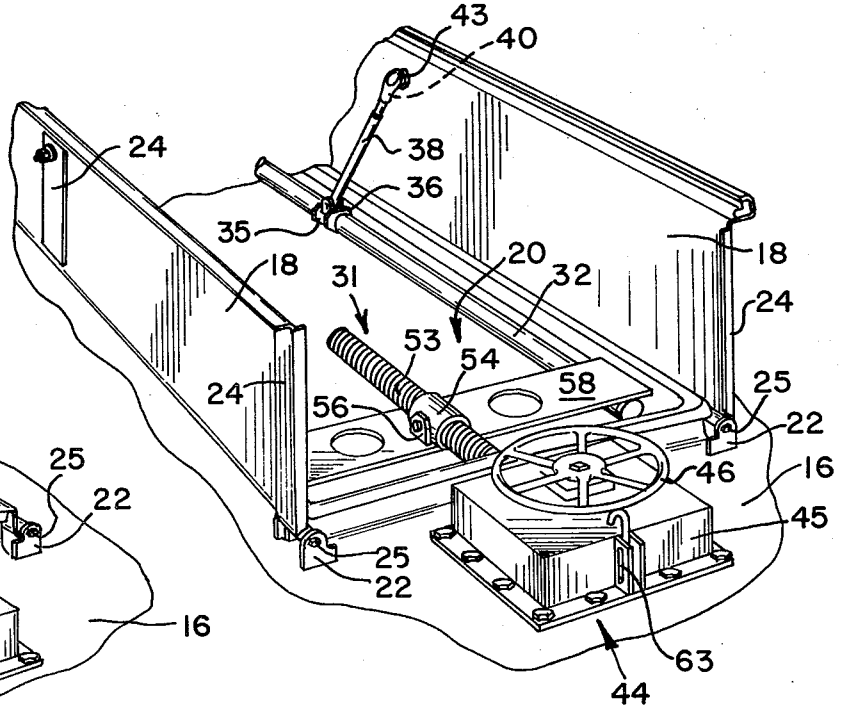
FIG. 4 is a view similar to FIG. 3 showing the hatch covers in an upright open position.
Figure 5:
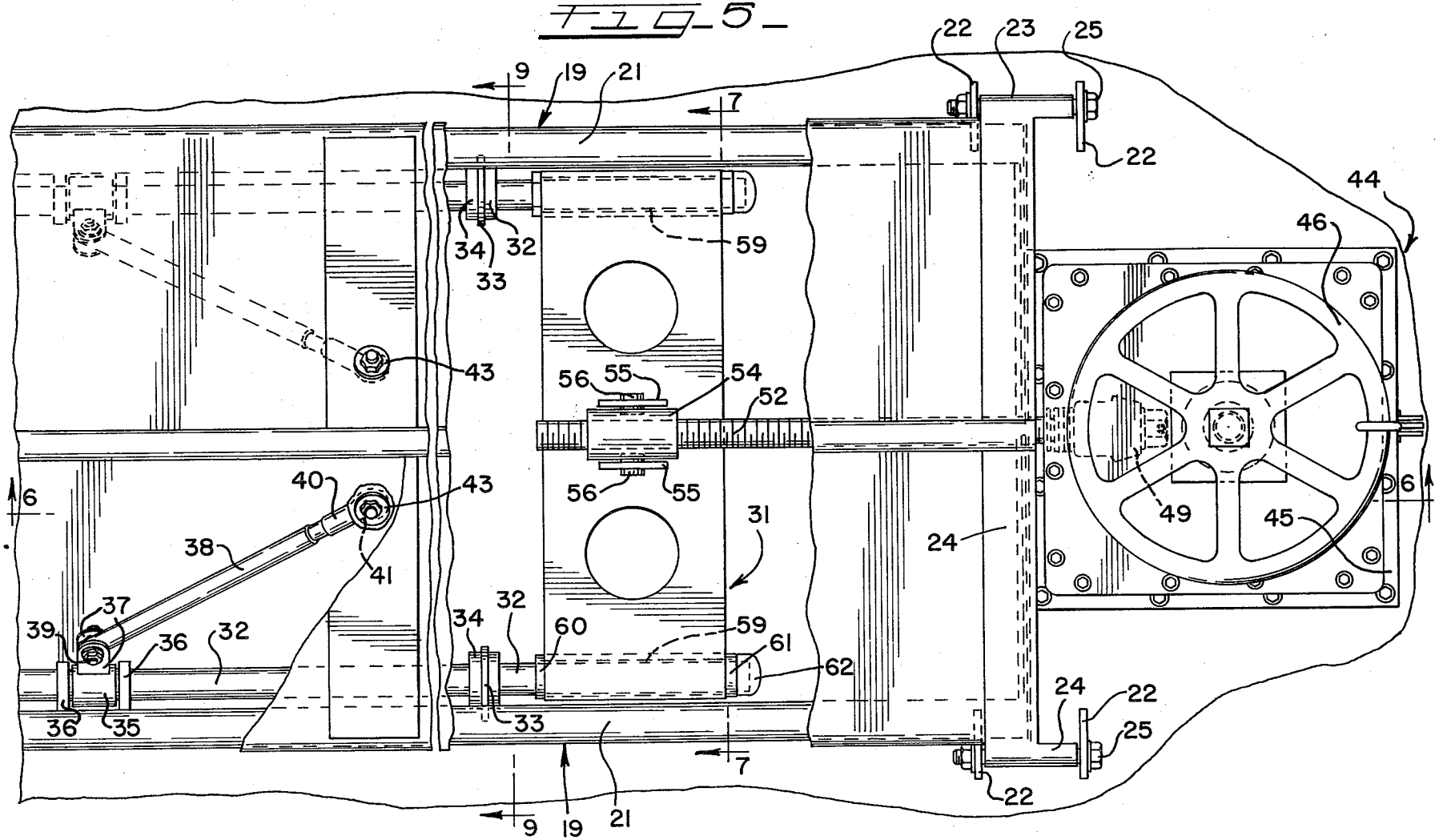
FIG. 5 is an enlarged plan view of one end of a railway hopper car roof showing an operating mechanism and motor for actuating hatch covers with portions of the hatch covers broken away to show the internal operating mechanism.
Figure 7:
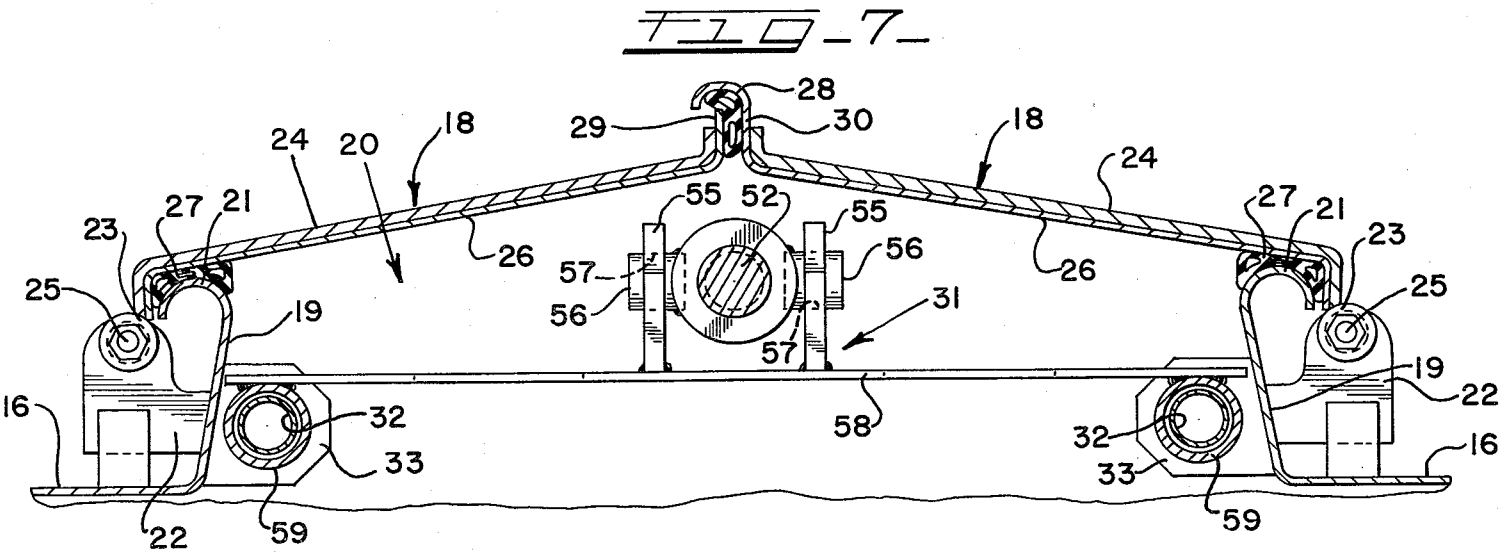
FIG. 7 is a cross-sectional view taken substantially along the line 7—7 of FIG. 5.
Figure 8:
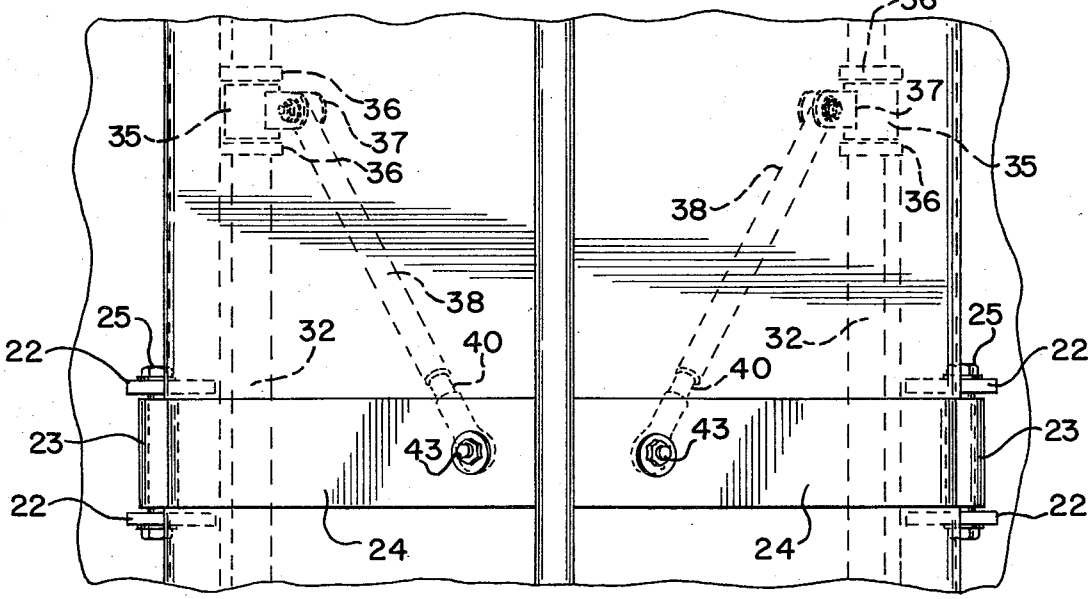
FIG. 8 is a fragmentary plan view of a pair of hatch covers.
Figure 9:
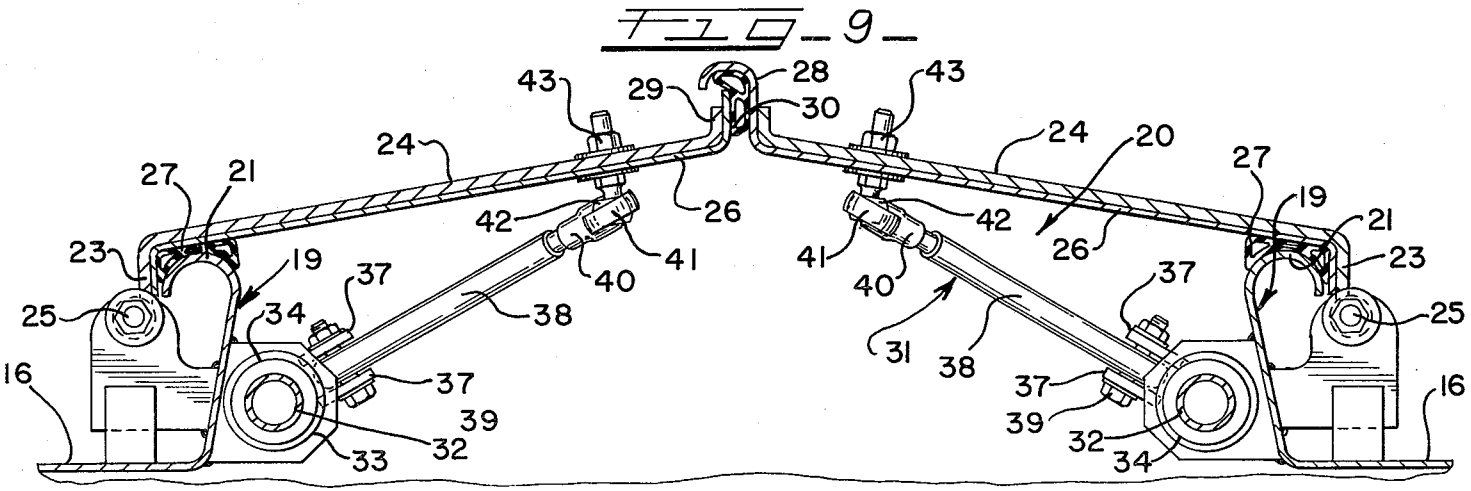
FIG. 9 is a cross-sectional view taken substantially along the line 9—9 of FIG. 5.
Figure 11:
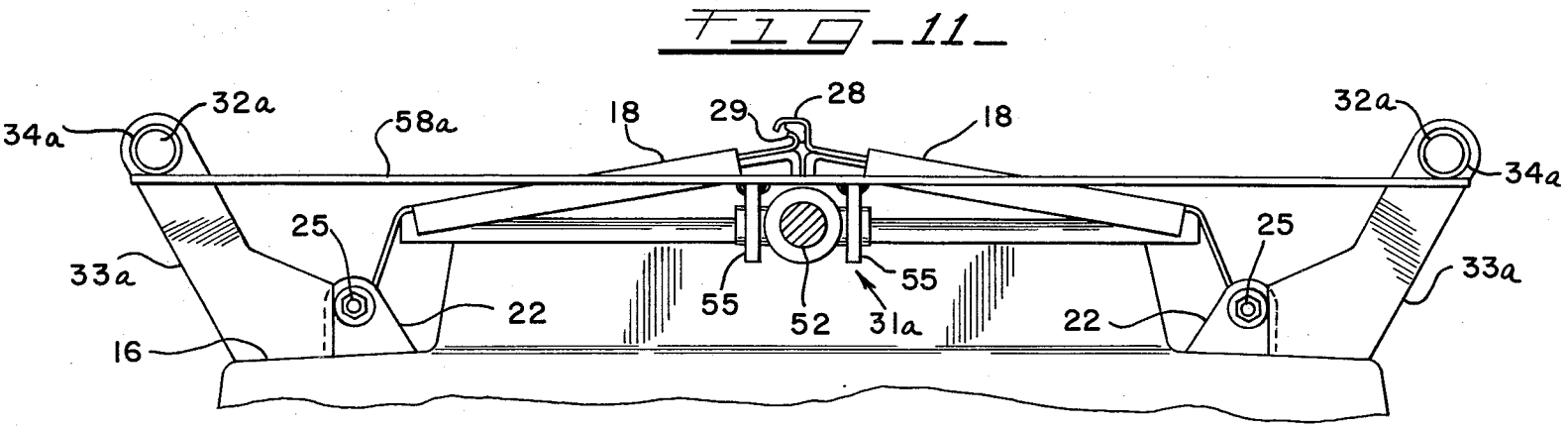
FIGS. 10–13 are illustrative of a modified form of the invention showing the elevating rods and push-pull bars to be external of the hopper body.
Figure 10:
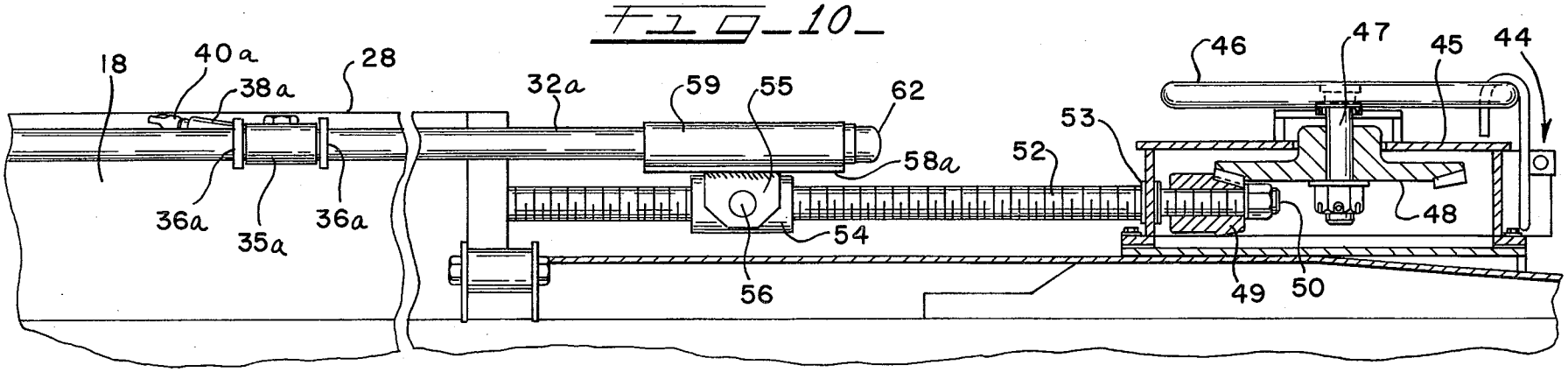
Figure 12:
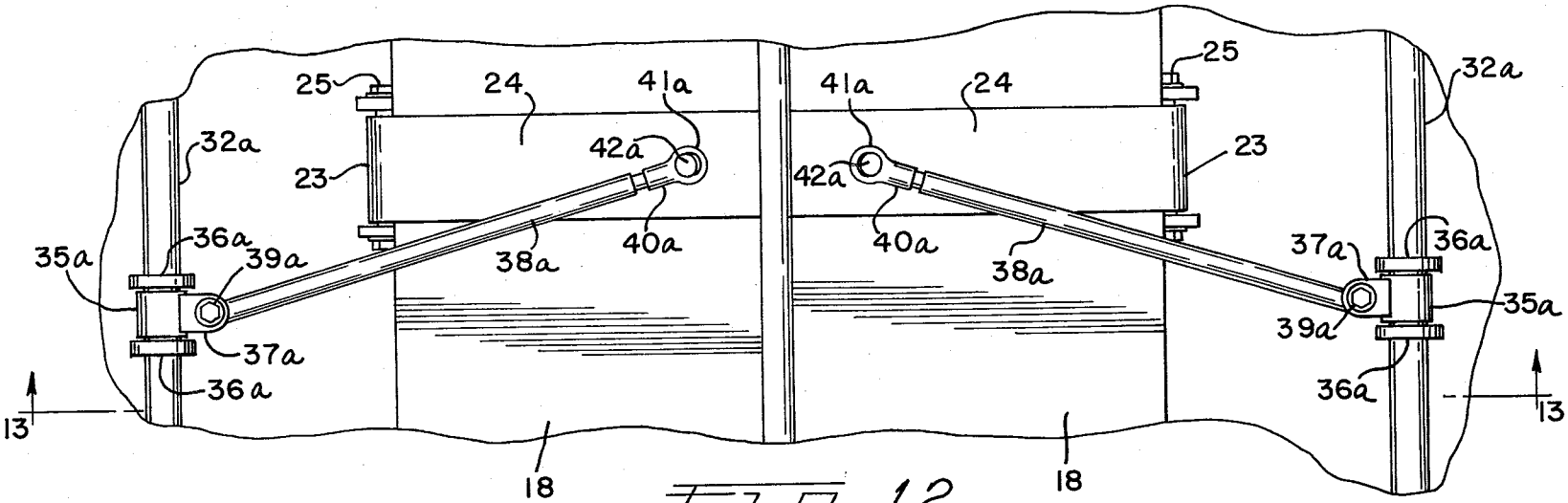
Figure 13:
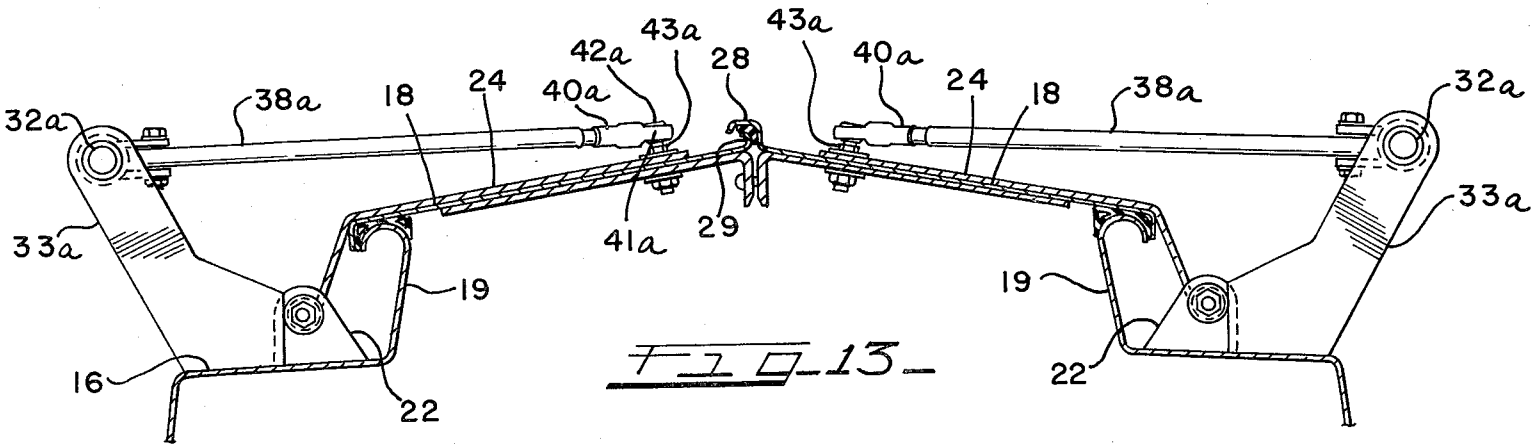

The hopper car 10, as best shown in FIG. 2, includes a sheathed roof construction 16 provided with suitable conventional walkways or running boards 17. A pair of elongated hatch covers 18 are positioned on top of hatch coaming 19 which defines an elongated hatch opening 20. The coaming 19 extends completely around the hatch opening 20 and is provided with an upper arcuate or rounded flange 21. As best shown in FIGS. 4, 5, and 7, longitudinally spaced hinge brackets 22 are rigidly connected to the coaming 19 and to the roof construction 16. Hinges 23 are connected to horizontally extending straps 24. The straps 24 are suitably connected to the top of the hatch covers 18 and extend along the length thereof in longitudinally spaced relation as best shown in FIG. 2. The hinges 23 are connected to the hinge brackets 22 by means of hinge bolts 25. The hatch covers 18 are formed by hatch cover sheets 26, to which the straps 24 are rigidly secured with the sheets 26 extending the length of the hatch opening 20 as indicated. In the closed position as best shown in FIGS. 7 and 9, the outer most ends of the hatch covers 18 are sealed by means of end seals 27 which sealingly engage the arcuate flanges 21. The inner ends of the hatch covers sheets 26 are provided with vertically extending flanges 28 and 29 which are also in the closed position of the hatch covers effectively sealed by means of a longitudinally extending seal 30 rigidly secured to one of the flanges.

Figure 6:
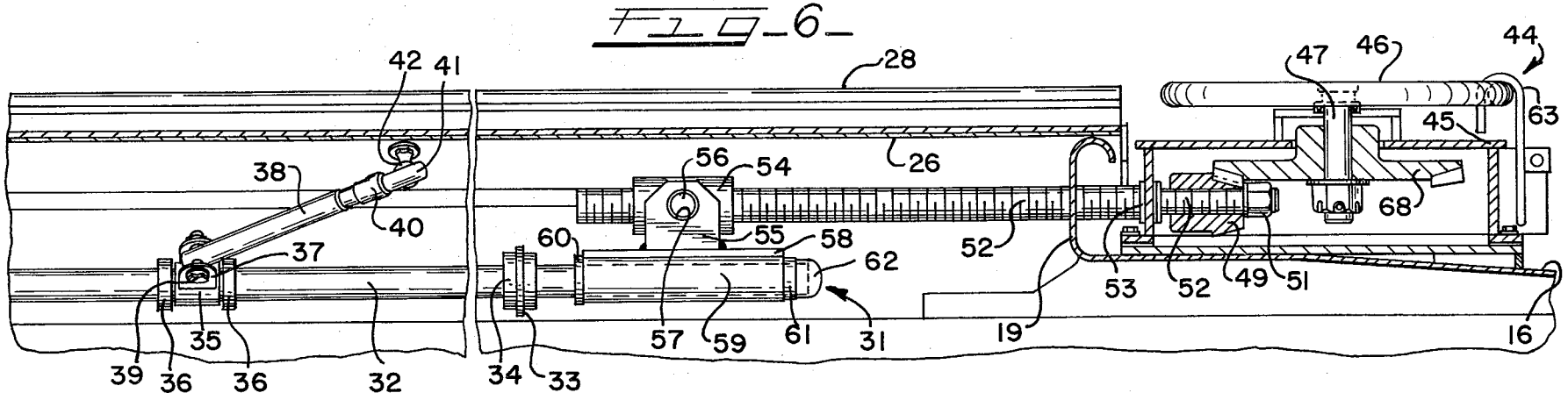
FIG. 6 is a cross-sectional view taken substantially along the line 6—6 of FIG. 5.

Referring now particularly to FIG. 6, an operating mechanism 31 for actuating the hatch covers 18 includes a pair of cylindrical longitudinally extending push-pull or thrust bars 32. The bars 32 are longitudinally movable and supported by slide brackets 33 supported within the hatch opening 20 on the hatch coaming 19 at longitudinally spaced intervals as best shown in FIG. 2. The slide brackets 33 include a short section of tube 34 which may be internally suitable coated by a plastic such as Teflon which facilitates the longitudinal sliding movement of the thrust bars 32. At spaced longitudinal intervals there are provided tubular sleeves or collars 35 which are retained in position on the bars 32 by means of rigid or fixed rings 36. The collars or sleeves 35 are relatively rotatable about the longitudinal axis of the bars 32. The sleeves 35 include connecting ears 37 to which are pivotally connected thrust links 38 by means of pivot bolts 39. The thrust links 38 may also be referred to as elevating rods. One end of each elevating rod 38 is provided with a conventional adjustable extension 40 which in turn includes a universal joint ring or part 41, as best shown in FIG. 6, which in turn is connected to a ball joint 42 which by means of a bracket connection 43 is rigidly secured through the hatch covers sheets 26 and straps 24. As indicated the ball joint 42 projects downwardly into the hatch opening 20.

Figure 3:
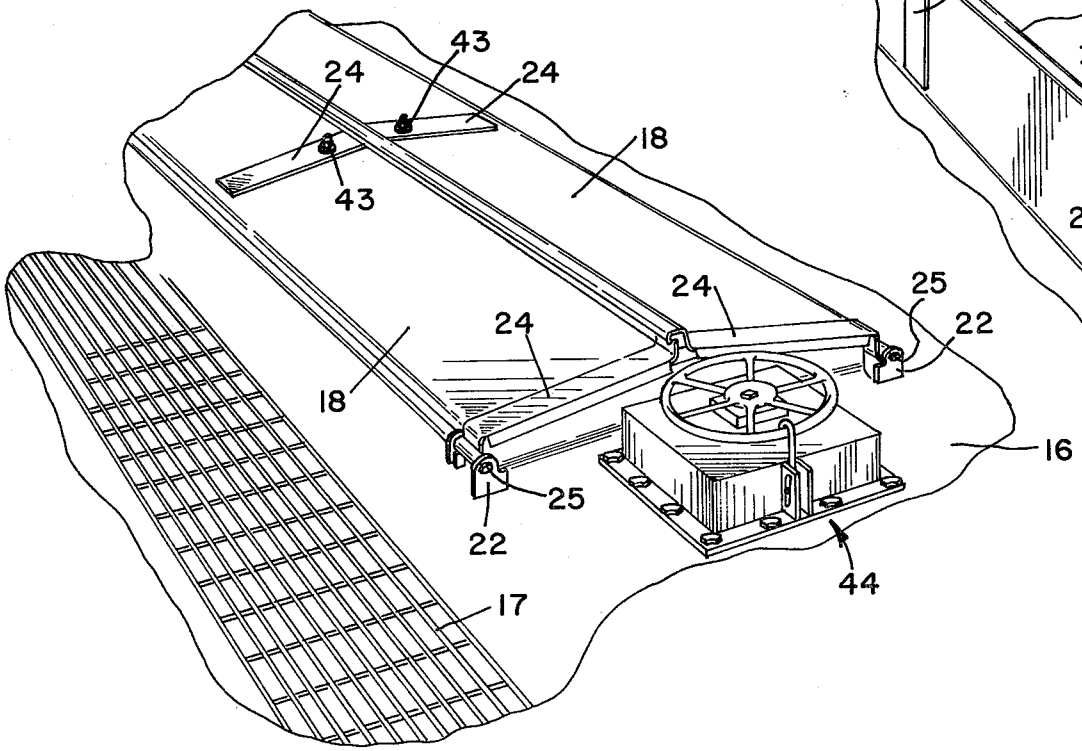
FIG. 3 is a perspective view of a roof portion of a railway hopper car showing a motor arrangement positioned at one end of a pair of hinged hatch covers.

Referring particularly to FIGS. 3, 4, and 5, a motor 44 is provided at one end of the hatch covers 18. The motor 44 comprises a housing 45 rigidly secured to the roof construction 16. A hand wheel 46 includes a shaft 47 suitably supported on the housing as indicated at FIG. 6 with the shaft 47 being connected to drive a gear 48. The gear 48 is in driving engagement with a pinion gear 49 rigidly secured to a threaded extension 50 by means of a nut 51. The threaded extension 50 in turn is rigidly connected to a threaded drive screw 52 which at one end as indicated in FIG. 6 is suitably supported by a journal bearing 53 at one end of the housing 45. The threaded drive screw 52 extends through a laterally extending portion of the coaming 19 into the hatch opening 20.

An internally threaded follower 54 is supported on the drive screw 52 for longitudinal driving movement with respect thereto. The follower 54 is pivotally supported on a yoke comprising a pair of vertical bracket members 55 by means of pivot members 56 as best shown in FIGS. 6 and 7. A transversely extending push-pull or thrust plate 58 is connected to the lower ends of the bracket members 55 and is in turn connected at opposite ends rigidly to sleeves 59 within which the rear ends of the push-pull bars are supported. The push-pull bars 32 may rotate about their own axis within the sleeves 59 and are secured against longitudinal movement relative thereto by means of stop washers 60 and 61 which are rigidly connected to the ends of the bars 32 and between which the sleeves 59 are confined. Caps 62 are connected to the ends of the push-pull bars 32. FIGS. 10–13 are illustrative of a modified form of the invention wherein the elevating rods 38*a*—38*a* and the push-pull bars 32*a*—32*a* and the attendant structure are located externally of the hopper car. Where the structure in this modified form is identical to the structure in the first embodiment the same reference characters are applied, but where the structure in the modification functions in the same manner but is structurally difference or located in physical position, the same reference characters are used with a small letter "*a*" following the reference character. Placing of the operating mechanism including the push-pull bars, the elevating rods and attendant structure obviates the obstruction of the grain flow into the hopper car and permits other structure to be located there when required for other hopper car operations.

THE OPERATION

FIGS. 1, 2, 3, and 5–9, disclose the hatch covers 18 in the closed position. In order for the operator to move the hatch covers to the open position shown in FIG. 4, he simply rotates the hand wheel 46 which in turn causes rotation of the pinion 49 and the drive screw 52. The push-pull thrust plate 58 and follower 54 are now moved in a direction to the right as disclosed in FIG. 6 which thereupon exerts a pulling force on the tubular sections or sleeve 35 which causes the elevating links 38 to exert an upward and outward force against the hatch covers 18 whereupon they are moved to the open position shown in FIG. 4. In the closed position of the elevating rods 38 they extend inwardly and upwardly in diagonal relation relative to the hatch covers 18. In the open position as shown in FIG. 4, the elevating rods extend substantially vertically and maintain the doors in the substantial vertical position as indicated. The entire length of the hatch opening is now accessable for loading and discharging material into the interior of the hoppers. During the opening and closing movements the elevating links 38 have a universal connection to the ball joint 42 at one end and are pivotally connected as indicated at their other ends to the ears 37 with the collars or sleeves 35 also being rotatable on the rods 32.

In order to again move the hatch covers 18 to the closed position, it is a simple matter to rotate the handwheel 46 in an opposite direction which in turn returns the follower 54 to the position shown in FIG. 6 whereupon the elevating rods 38 again lower the hatch covers and lock them in the secure sealed relation relative to the hatch opening. The handwheel 46 as best shown in FIGS. 4 and 6 may also be locked against rotation by means of a stop link assembly 63 which may be readily disengaged from the handwheel 46 by the operator. In the second embodiment disclosed in FIGS. 10–13 the push-pull bars, the elevating rods and attendant structure have the overall similiar operations like the structure shown in the first embodiment of FIGS. 1–9, but do have the advantage that they are free from contact with the material being placed in the hopper car.

The foregoing disclosure describes the invention wherein an elongated hatch opening is effectively sealed and covered by a pair of hatch covers which in the open position are out-of-the-way of personnel walking on the roof structure of the car during loading procedure. Also the entire opening may be closed by a simple operating motor actuated by an operator positioned at one end of the roof. Thus, the disadvantages of the constructions disclosed in the prior art are overcome in an effective arrangement over the prior art devices is hereinabove discussed.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A railway hopper car having a roof including a longitudinally extending hatch opening, hatch cover means hingedly connected to said roof and movable from a closed position covering said opening to an open position, the improvement comprising:

an operating mechanism for moving said hatch cover means including;

a pair of longitudinally extending thrust bars attached to the roof adjacent the opening to define a top pour space between said thrust bars and movably supported with respect to said roof, thrust element means rotatably supported on each of said thrust bars and fixed relative thereto against longitudinal movement, said hatch cover means comprising a pair of hatch covers extending the length of the hatch opening, link means pivotally connected at one end to said thrust element means and pivotally connected at its other end to one of said hatch covers;

and motor means connected to said thrust bars for moving the thrust bars longitudinally to open and close said hatch covers, whereby there is defined a pour space in the open position of the hatch cover means.

2. A railway hopper car having a roof including a longitudinally extending hatch opening, hatch cover means hingedly connected to said roof and hingedly movable from a closed position covering said opening to a substantially vertical open position, the improvement comprising;

an operating mechanism for hingedly moving said hatch cover means including;

longitudinally extending thrust bar means movably supported with respect to said roof, thrust element means rotatably supported on said thrust bar means and fixed relative thereto against longitudinal movement, link means pivotally connected at one end to said thrust element means, means pivotally connecting the other end of said link means to the hatch cover means whereby in the closed position of said hatch cover means said link means extends from its point of connection to said thrust element means, and motor means connected to said thrust bar means for moving said thrust bar means longitudinally in one direction to raise said cover to an open position and in an opposite direction to lower said cover to said closed position, said hatch cover means comprising a pair of hatch covers having inner-longitudinal edges in sealing relation in the closed position of said covers, said thrust bar means including a pair of thrust bars supported on the roof, each of said bars rotatably supporting at least one thrust element, and said link means including at least one link connected to each thrust element and each hatch cover.

3. The invention in accordance with claim 2, said thrust elements each comprising a collar, said means pivotally connecting said links to said covers including a universal joint connection.

4. The invention in accordance with claim 2, said motor means comprising, a drive member mounted on said car beneath said hatch covers, an operating member connected to said drive member for reciprocating the same longitudinally, and a transversely extending connecting element connecting both thrust bars.

5. The invention in accordance with claim 4, said drive member comprising a drive screw, said operating member including a pinion and said screw for rotating the same, a gear engaging said pinion in driving relation, and a hand operable member connected to said gear for rotating the same.

6. The invention in accordance with claim 5, said connecting element having a screw follower connected thereto in driven engagement with said drive screw.

7. The invention in accordance with claim 2, brackets supported on said roof for slidingly supporting said thrust bars, said motor means including a drive member having one end connected to said thrust bars, and the other end connected to said motor means positioned on the roof of said car adjacent one end of said hatch covers.

8. The invention according to claim 7, said roof including upstanding coaming coextensive with said opening, and said brackets being supported on said coaming within said opening.

9. The invention according to claim 7, said roof including upstanding coaming coextensive with said opening, and brackets supported on said roof outwardly of said coaming.

10. The invention in accordance with claim 2, said motor means comprising a drive screw mounted on said car beneath said hatch covers and projecting outwardly from said opening, a thrust plate connected to thrust bars, a screw follower connected to said screw to be driven thereby, means pivotally connecting said follower to said thrust plate, and operating means on said car outwardly of said opening engaging said drive screw for rotating the same.

11. The invention according to claim 2, and wherein one of each of the thrust bars being supported under each cover within said hatch opening.

12. The invention according to claim 2, and wherein one of each thurst bars being supported outwardly of each cover and without said hatch opening.

* * * * *